US011318592B2

(12) United States Patent
Dodds

(10) Patent No.: US 11,318,592 B2
(45) Date of Patent: May 3, 2022

(54) HYDRAULIC TORQUE WRENCH

(71) Applicant: Torque Tension Systems Limited, Ashington Northumnerland (GB)

(72) Inventor: Tony Dodds, Northumberland (GB)

(73) Assignee: SPX FLOW TECHNOLOGY ENGLAND LIMITED, Leeds (GB)

( * ) Notice: Subject to any disclaimer, the term of this patent is extended or adjusted under 35 U.S.C. 154(b) by 0 days.

(21) Appl. No.: 16/349,797

(22) PCT Filed: Nov. 14, 2017

(86) PCT No.: PCT/GB2017/053426
§ 371 (c)(1),
(2) Date: May 14, 2019

(87) PCT Pub. No.: WO2018/087575
PCT Pub. Date: May 17, 2018

(65) Prior Publication Data

US 2019/0358793 A1 Nov. 28, 2019

(30) Foreign Application Priority Data

Nov. 14, 2016 (GB) ..... 1619283

(51) Int. Cl.
*B25B 23/145* (2006.01)
*B25B 21/00* (2006.01)
(Continued)

(52) U.S. Cl.
CPC ..... *B25B 23/145* (2013.01); *B25B 21/005* (2013.01); *B21B 2203/12* (2013.01);
(Continued)

(58) Field of Classification Search
CPC ... B25B 23/145; B25B 21/005; B25B 13/463; B25B 13/481; B25B 23/0078; B21B 2203/12
See application file for complete search history.

(56) References Cited

U.S. PATENT DOCUMENTS 1,412,290 A * 4/1922 McCafferty ..... B25B 13/463 81/61
1,761,263 A * 6/1930 Haist ..... B25B 13/463 76/114

(Continued)

FOREIGN PATENT DOCUMENTS

DE 4040140 6/1992

OTHER PUBLICATIONS

Written Opinion, PCT/GB2017/053426, pp. 1-5.

*Primary Examiner* — Thomas M Wittenschlaeger
*Assistant Examiner* — Katie L Gerth
(74) *Attorney, Agent, or Firm* — The Belles Group, P.C.

(57) ABSTRACT

A hydraulic torque wrench is disclosed and includes a nut engaging portion with ratchet teeth on an external surface thereof. There is also a support member which can rotate relative to whilst retaining the nut engaging portion. A ratchet mechanism cooperates with the ratchet teeth to apply a rotational force to the nut engaging portion as a result of the pushing force from a hydraulic ram. Side plate cover a junction between the nut engaging portion and the support member with the side plates having a noncircular aperture through which a nut and bolt can extend when the wrench is in use.

10 Claims, 5 Drawing Sheets

(51) Int. Cl.
*B25B 13/46* (2006.01)
*B25B 13/48* (2006.01)
*B25B 23/00* (2006.01)

(52) U.S. Cl.
CPC ..... *B25B 13/463* (2013.01); *B25B 13/481* (2013.01); *B25B 23/0078* (2013.01)

(56) References Cited

U.S. PATENT DOCUMENTS 2,496,762 A * 2/1950 Weyrauch ..... B25B 13/481 81/57.43
2,578,686 A * 12/1951 Fish ..... B25B 13/463 81/124.2
2,578,687 A * 12/1951 Fish ..... B25B 13/463 81/58.2
2,708,855 A * 5/1955 Fish ..... B25B 13/463 81/61
2,758,493 A * 8/1956 Goldwater ..... B25B 13/463 81/58.2
4,080,851 A * 3/1978 Rogers ..... B25B 13/04 81/60
4,095,494 A * 6/1978 Castoe ..... B25B 13/463 81/176.2
4,339,969 A * 7/1982 Hage ..... B25B 13/467 81/57.39
4,592,255 A * 6/1986 Mayer ..... B25B 13/463 81/62
4,744,271 A * 5/1988 Collins ..... B25B 13/462 81/57.39
4,854,197 A * 8/1989 Walton ..... B25B 13/462 81/57.39
5,003,847 A * 4/1991 Wagner ..... B25B 21/00 81/57.39
5,005,447 A * 4/1991 Junkers ..... B25B 21/005 81/57.39
5,203,238 A * 4/1993 Ferguson ..... B25B 21/005 81/57.39
5,467,672 A * 11/1995 Ashby ..... B25B 13/08 81/58.2
5,544,553 A * 8/1996 Galat ..... B25B 13/481 81/57.13
5,584,220 A * 12/1996 Darrah ..... B25B 13/463 81/57.29
5,671,643 A * 9/1997 Henkhaus ..... B25B 13/461 81/57.39
5,842,391 A * 12/1998 Chaconas ..... B25B 13/463 81/60
7,062,993 B2 * 6/2006 Shaw ..... B25B 21/005 81/54
7,117,764 B2 * 10/2006 Garric ..... B25B 21/002 81/57.39
7,497,147 B2 * 3/2009 Koppenhoefer ..... B25B 21/005 81/57.39
8,104,381 B1 * 1/2012 Chen ..... B25B 13/463 81/63.2
8,661,945 B1 * 3/2014 ElDessouky ..... B25B 13/481 81/58.2
9,550,282 B2 * 1/2017 Davis ..... B25B 21/005
10,926,381 B2 * 2/2021 Wilson, Jr. ..... B25B 13/481
2002/0121161 A1 * 9/2002 Koppenhoefer ..... B25B 21/005 81/57.39
2004/0200320 A1 * 10/2004 Knopp ..... B25B 21/005 81/57.39
2008/0289460 A1 * 11/2008 Whitehead ..... B25B 13/06 81/463
2011/0314972 A1 * 12/2011 Rickley, III ..... B25B 21/005 81/57.39
2012/0031240 A1 * 2/2012 Hsieh ..... B25B 13/463 81/63.2
2013/0036874 A1 * 2/2013 Chan ..... B25B 21/004 81/58.2
2013/0074315 A1 * 3/2013 Slocum ..... B25B 23/0078 29/525.01
2014/0182420 A1 * 7/2014 Chen ..... B25B 13/463 81/57.13
2014/0238203 A1 * 8/2014 Spirer ..... B25B 21/005 81/57.39
2015/0143961 A1 * 5/2015 Weber ..... B25B 13/04 81/58.2
2016/0297054 A1 * 10/2016 Abunameh ..... B25B 13/481
2016/0303715 A1 * 10/2016 Huang ..... B25B 23/0035
2016/0311089 A1 * 10/2016 Davis ..... B25B 21/005

* cited by examiner

HYDRAULIC TORQUE WRENCH

CROSS-REFERENCE TO RELATED PATENT APPLICATIONS

The present application is a U.S. national stage application under 35 U.S.C. § 371 of PCT Application No. PCT/GB2017/053426, filed Nov. 14, 2017, which claims priority to United Kingdom Patent Application No. 1619283.3, filed Nov. 14, 2016. The disclosures of the aforementioned priority applications are incorporated herein by reference in their entireties.

BACKGROUND OF THE INVENTION

The present invention relates to a hydraulic torque wrench, and relates particularly, but not exclusively, to a torque wrench for applying a rotational force to an object such as a nut where the nut is in close proximity to other objects such as in closely spaced pipeline flanges and the like.

The use of bolted together flanges is commonplace in high-pressure pipeline systems. In order to ensure that the nuts and bolts on the flanges are sufficiently tight it is also commonplace to use hydraulic torque wrenches to tighten the nut onto a bolt. On occasion multiple flanges may be placed very close to each other and it is therefore preferable to have a torque wrench with a minimal depth to the head of the tool. The depth of the head of the tool is the distance between the opposing faces of the tool, these faces being perpendicular to the axis of rotation of the tool, and therefore that distance being measured parallel to the axis of rotation.

Traditionally torque wrenches have included support plates on either side of the tool around the nut engaging head of the tool. However, these support plates increase the thickness of the torque wrench at the head and variations on these torque wrenches have been produced in which the support plates have been removed. Some products have been produced with thinner support plates which take up less room, thereby allowing the tool to operate in smaller spaces. However, such support plates provide reduced support and wear very quickly thereby significantly reducing the life of the tool. In some further products the complete removal of the support plates further reduces the size of the head of the tool but leaves elements of the mechanism and moving parts of the torque wrench exposed which risks injury to operators. In particular, pinch injuries can occur between the exposed junctions of the components that form the head of the tool and items can get caught in the components, especially the ratchet teeth, and be pulled into the tool as it slowly turns.

Preferred embodiments of the present invention seek to overcome or alleviate the above described disadvantages of the prior art.

BRIEF SUMMARY OF THE INVENTION

According to an aspect of the present invention there is provided a hydraulic torque wrench for applying a rotational force to an object, the torque wrench comprising:

a body;

an object engaging portion for engaging an object to which rotational force is to be applied, the engaging portion having an engaging aperture having internal surfaces arranged to engage the object and a plurality of first ratchet teeth on an external surface thereof;

a support member for retaining the object engaging portion, the support member movable relative to said body and said object engaging portion;

at least one ratchet mechanism cooperating with said first ratchet teeth to facilitate the application of a rotational force to said object engaging portion in a first rotational direction in response to a force being applied to said support member in a first substantially linear direction and said ratchet mechanism preventing the application of a rotational force in a second rotational direction, opposite to said first rotational direction; and side plates extending from said body at least partially covering a junction between said object engaging portion and said support member, said side plates comprising an aperture through which said object can extend when the wrench is in use, wherein said aperture is noncircular.

By providing the side plates of the head of a torque wrench with a noncircular aperture the advantage is provided that the side plates can be made from very thin material whilst still offering the protection provided by traditional support plates used in existing wrenches. If traditionally thick support plates are used these prevent any movement transverse to the axis of rotation of the components of the head of the wrench, therefore wear on the support plates is minimal and as a result the transverse movement is not noticed. If a torque wrench without support plates is used the movement of the components of the head relative to the body is not noticeable. If the support plates were to be thinned to reduce the thickness of the head of the wrench the resulting plates would become damaged. It is of particular significance that the noncircular aperture in the side plates of the head of the torque wrench of the present invention do not become damaged but protect operators from pinch and other injuries.

In a preferred embodiment the non-circular aperture is based on two non-concentric overlapping circles.

By using nonconcentric overlapping circles as the basis for the aperture the advantages provided that the transverse non-rotational movements of the object engaging portion and the support member are accommodated within the aperture.

In another preferred embodiment the circles have different diameters.

Using circles of slightly different diameters creates the perfect shape for offering the maximum protection and coverage of the junction between the object engaging portion and the support member whilst almost completely eliminating contact between these components and the edges of the side plates which could result in wear and damage.

In a further preferred embodiment one of the circles is concentric with an axis of rotation of said object engaging portion.

The ratchet mechanism may comprise a ratchet member having at least one second ratchet tooth for engaging said first ratchet teeth.

In a preferred embodiment the engaging aperture is substantially hexagonal.

The wrench may further comprise at least one hydraulic ram for applying said force in said first substantially linear direction to said support member.

The wrench may further comprise at least one connector portion for connecting said hydraulic ram to a supply of hydraulic fluid.

The wrench may further comprise at least one hydraulic pump unit for supplying said hydraulic fluid under pressure to said hydraulic ram via said connector.

BRIEF DESCRIPTION OF THE DRAWINGS

Preferred embodiments of the present invention will now be described, by way of example only, and not in any limitative sense with reference to the accompanying drawings in which.

DETAILED DESCRIPTION OF THE INVENTION

Figure 1:
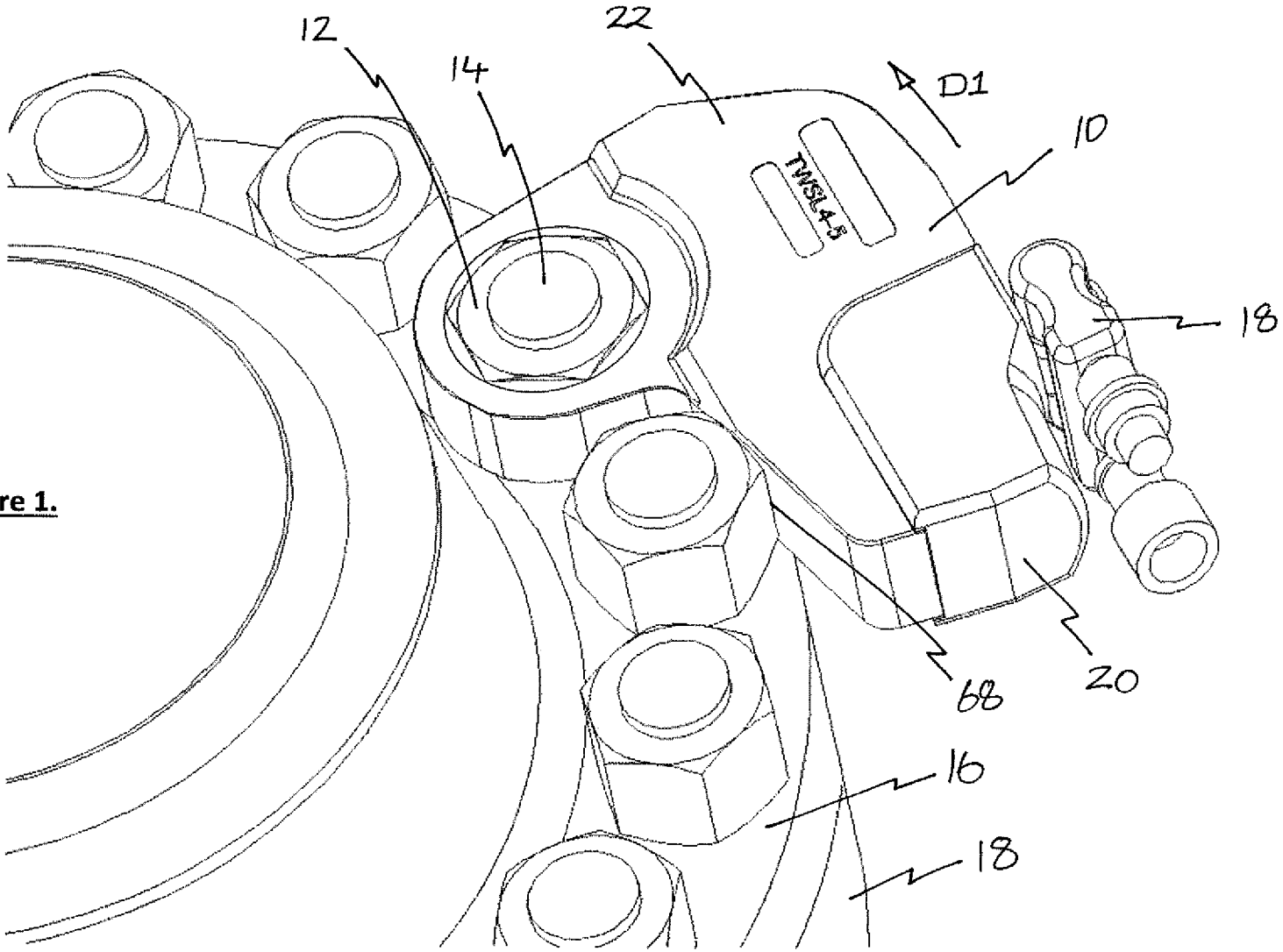
FIG. 1 is a perspective view of a device of the present invention positioned as though for use.

Referring initially to FIG. 1, a hydraulic torque wrench 10 is provided to apply a rotational force to an object such as a nut 12 which is in threaded engagement with a bolt 14. This bolt 14, together with other nuts and bolts shown in FIG. 1, are used to fix a flange 16 of an element of a pipeline to another flange 18 to connect two parts of a pipeline, or the like, together. The wrench 10 is powered by hydraulic fluid supplied from a hydraulic pump unit (not shown) via pipelines (also not shown). The pipelines are fixed to a swivel connector 18 which is itself connected to a hydraulic cylinder 20 which contains a hydraulic ram (not shown). The hydraulic cylinder 20 is separable from the remainder of the wrench 10 and is designed to be used with different sizes of wrench to tighten different sized nuts. The use of this type of hydraulic cylinder 20 is known in the art.

Figure 2:
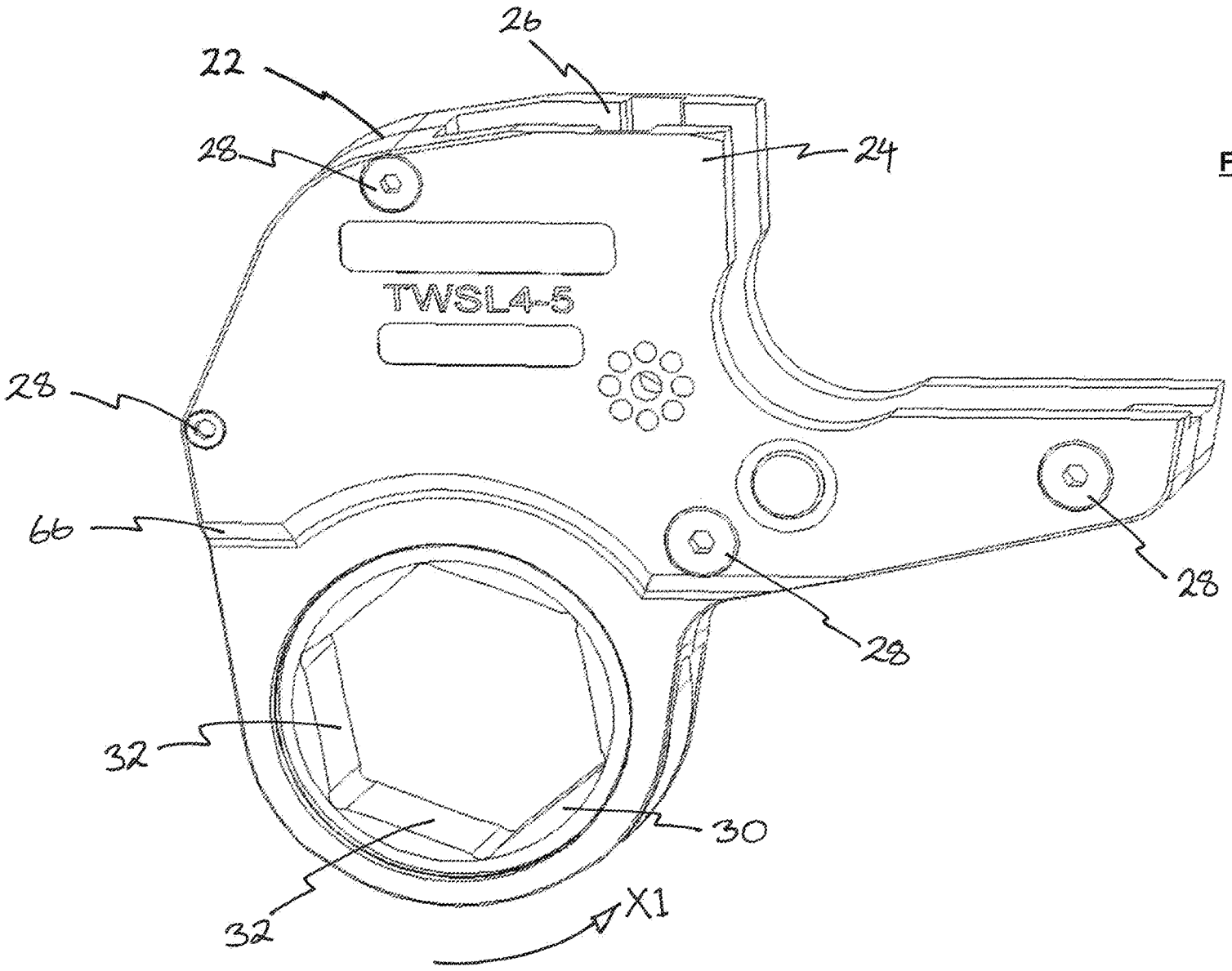
FIG. 2 is a perspective view of a portion of the device shown in FIG. 1.
Figure 3:
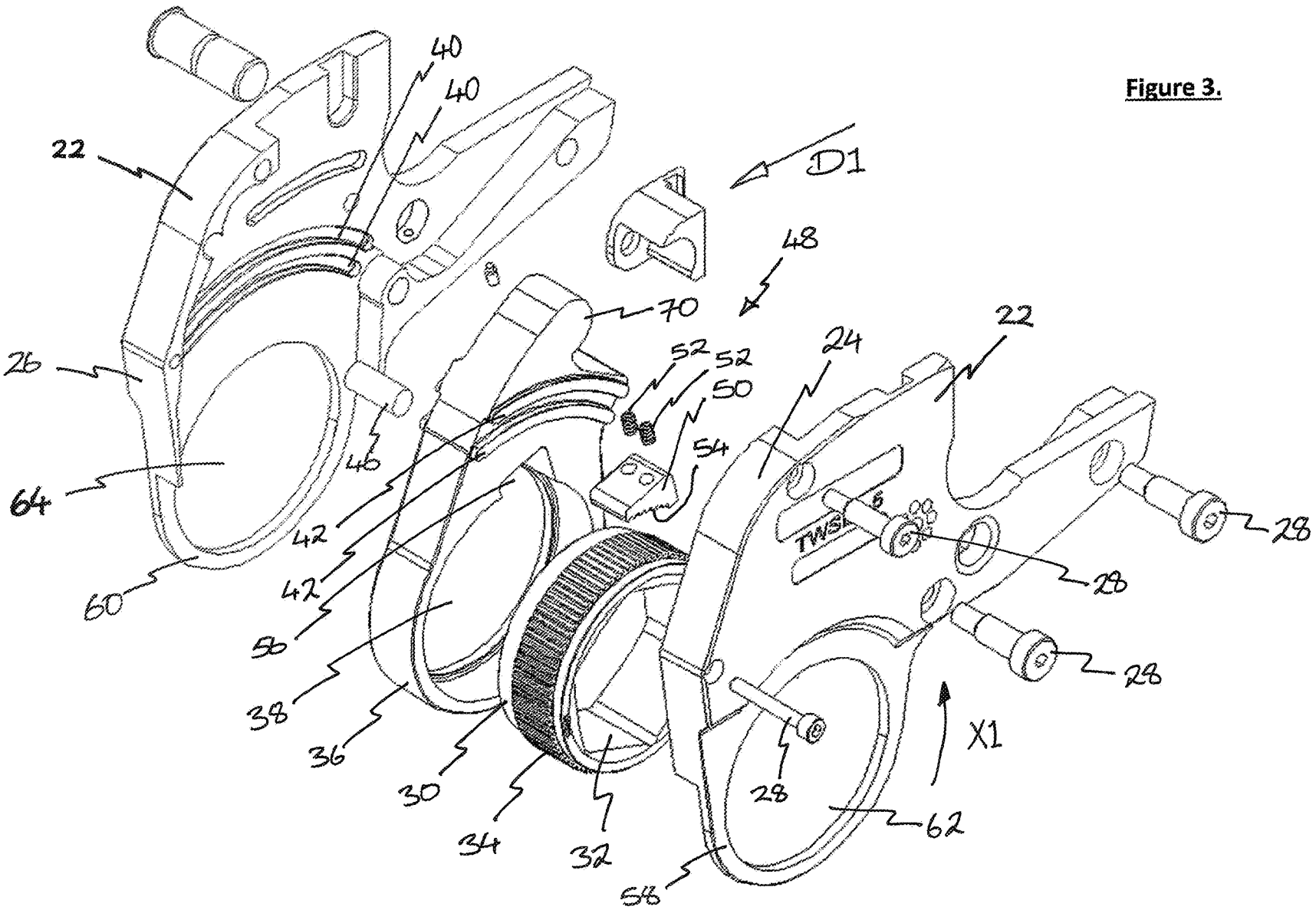
FIG. 3 is an exploded perspective view of the portion of the device shown in FIG. 2.

Referring further to FIGS. 2 and 3, the wrench 10 includes a body 22 which is formed from two body portions 24 and 26. A series of fixing bolts 28 are used to clamp the two body portions 24 and 26, which are substantially mirror images of each other, together. Also forming part of wrench 10 is an object engaging portion in the form of a nut engaging ring 30. When the wrench 10 is in use the nut engaging ring 30 engages the nut 12 to which rotational forces to be applied thereby tightening the nut. Internal surfaces 32 of the nut engaging ring 30 form a substantially hexagonal shape to engage the external surfaces of the hexagonal nut 12. The shape formed by the internal surfaces 32 can be any suitable shape to apply a rotational force to the object to be rotated as is familiar to person skilled in the art. An external surface of the nut engaging ring 30 is provided with multiple first ratchet teeth 34 which extends around the whole external circumference.

A support member 36 is provided which retains the nut engaging ring 30. The support member 36 substantially surrounds the nut engaging ring 30 and has an internal diameter slightly larger than the external diameter formed by the tips of the ratchet teeth 34 of the ring 30. As a result, the nut engaging ring 30 is able to rotate within the annular aperture 38 of the support member 36. The support member 36 is also able to move relative to the body 22 in a rotational movement which is controlled by a pair of grooves 40 formed on the inside of each of the body portions 24 and 26. Protrusions 42 extend into the grooves 40 and enforces a rotational movement of the support member 36 about the centre of the annular aperture 38. The movement of the support member 36 is also biased by a rubber stop 46 which is located in between plates 24 and 26.

Also forming part of the wrench 10 is a ratchet mechanism indicated generally at 48 and including a ratchet member 50 and a pair of springs 52. The ratchet teeth 54 of the ratchet member 50 engage the ratchet teeth 34 of the ring 30 so as to allow the rotation of the nut engaging ring 30 in a first rotational direction (relative to the body 22 and anticlockwise as seen in the figures) and substantially prevent the ring rotating in a second rotational direction opposite (clockwise) to said first direction. The above movement is described relative to the body 22 of the wrench 10. This movement is achieved by the movement of the support member 36 which contains a recess 56 in the annular aperture 38. The ratchet mechanism 48 sits within the recess 56 and the springs 52 bias the ratchet member 50 into engagement with the ratchet teeth 34 of nut engaging ring 30.

Figure 4:
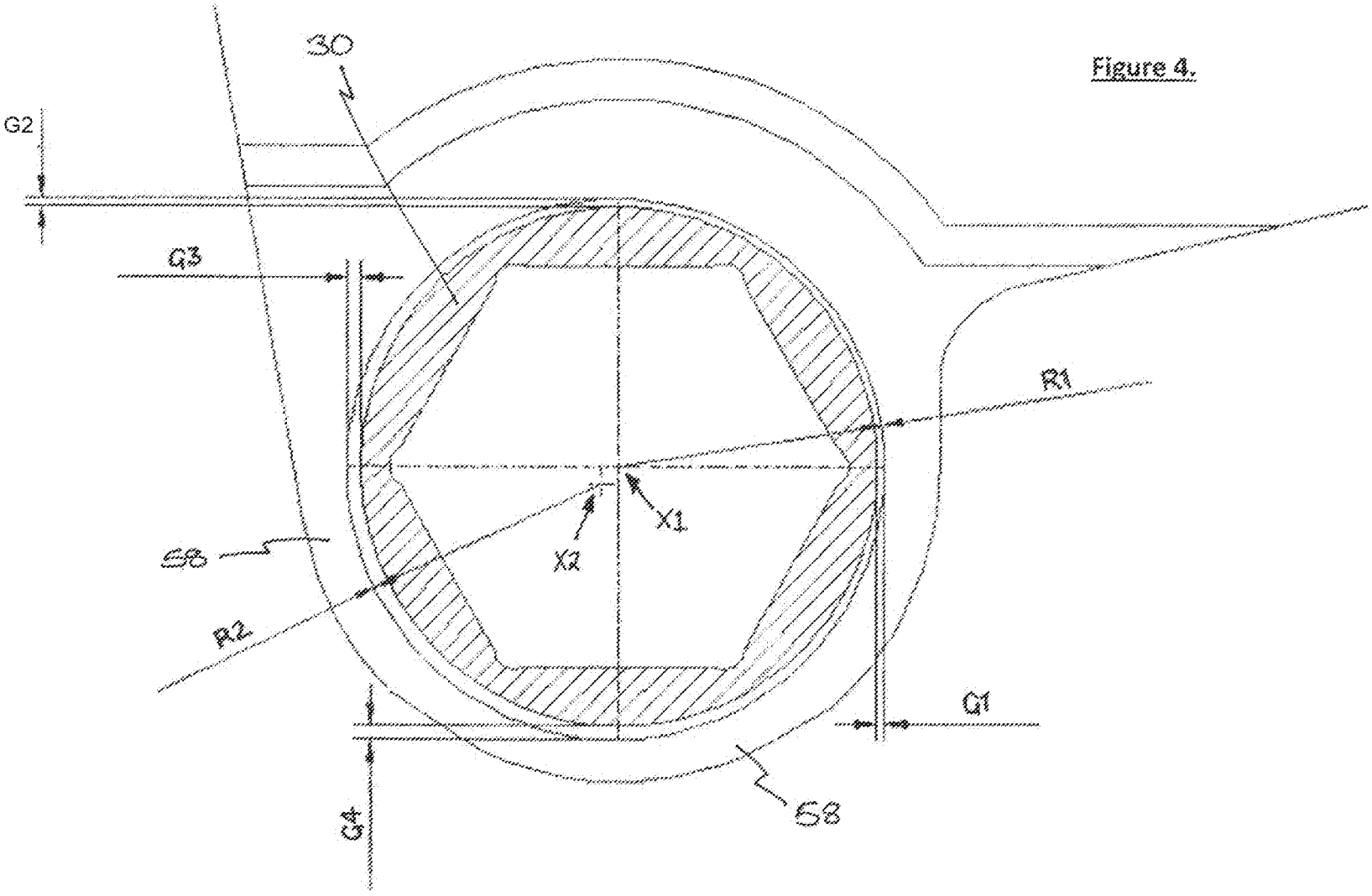
FIG. 4 is a top view of a part of the device of FIG. 1.
Figure 5:
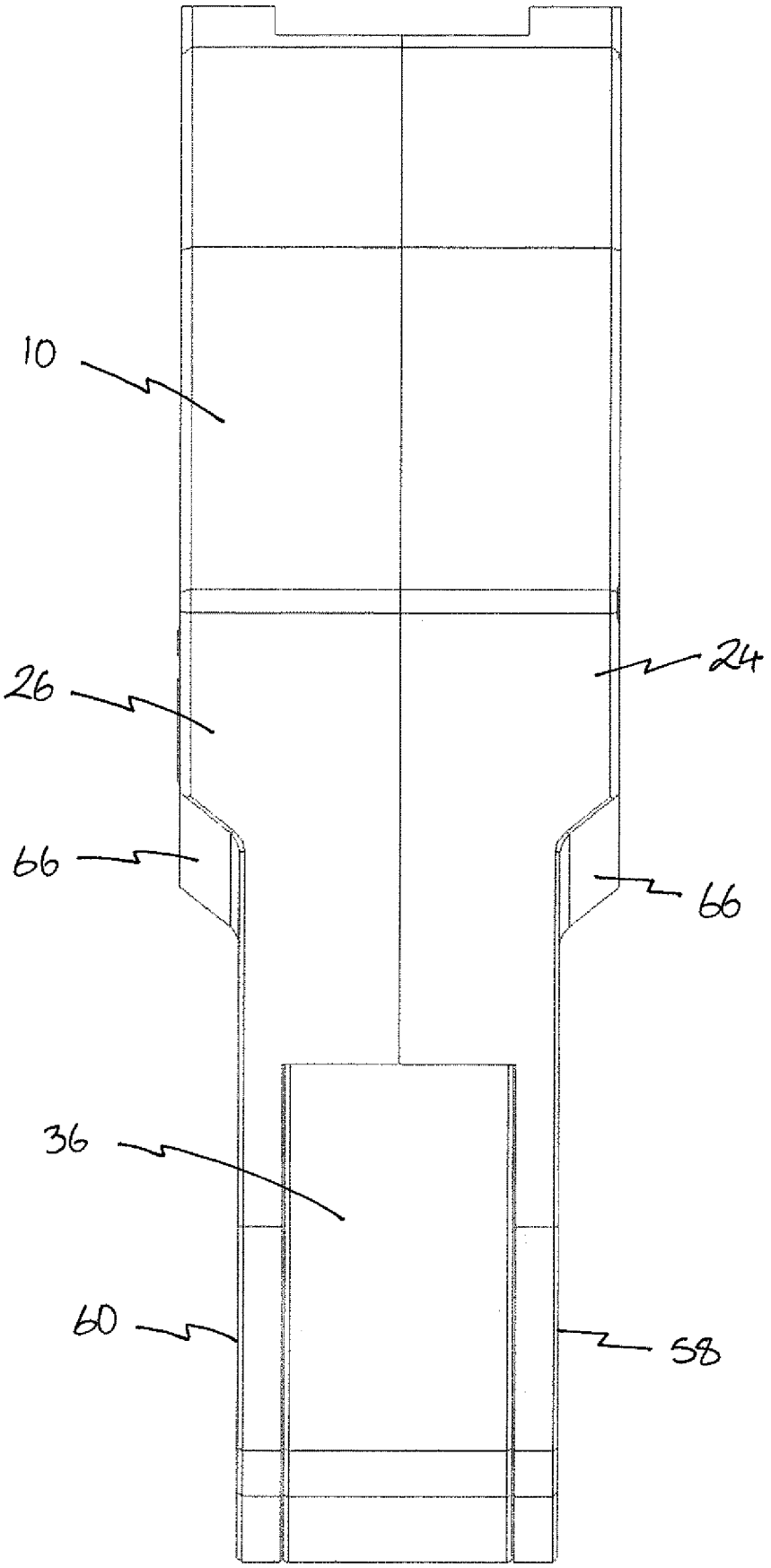
FIG. 5 is an end view of the device of FIG. 1.

Referring also to FIG. 4, extending from but formed as part of the body 22 are side plates 58 and 60 which, at least partially, cover the junction or gap between the external surface of nut engaging ring 30 with the ratchet teeth 34 and the inner surface of the annular aperture 38 of support ring 36. As can be seen from FIG. 4, the side plates almost completely cover the gap leaving only the smallest space. Each of the side plates 58 and 60 has a respective aperture 62 and 64 which are noncircular. Specifically the apertures 62 and 64 are based on two overlapping nonconcentric circles. For example, a first circle has a radius R1 and is concentric with the axis of rotation (indicated at X1) of the nut engaging ring 30. This circle is merged with a second circle having a radius R2 and a centre (indicated at X2). The radii R1 and R2 may be the same or may be slightly different. As a result, when the wrench is in a resting condition there is a minimal clearance gap between the edge of the nut engaging ring 30 and the side plate 58 indicated at G1 and G2 and a slightly larger gap indicated at G3 and G4. However, when the wrench 10 is in use and under full strain of the hydraulic ram then the forces applied to the nut engaging ring 30 cause slight movement relative to the body reducing the size of the gaps G3 and G4. It should also be noted that there is a significant step (indicated at 66) in moving from the body portion 22 to the side plates 58 and that this step is around the whole of the head of the wrench. As a result, the wrench of the present invention is able to work in very tight spaces and with nuts that are not very tall. This is most clearly illustrated in FIG. 5 which is an end view.

Operation of the device of the present invention will now be described. This operation is the same as for hydraulic torque wrenches of the prior art although the device of the present invention is able to operate in smaller spaces with greater safety and less likelihood of wear and damage. The torque wrench 10 is brought into engagement with a nut 12 which has been hand tightened on to a bolt 14. An edge portion, indicated at 68, of the body 22 engages an adjacent nut to the one being tightened and hoses from a hydraulic pump unit attached to the swivel connector 18. When the hydraulic ram is extended its substantially linear movement in direction D1 presses against an extension portion 70 of support member 36 causing it to rotate following the arc shape of groove 40. Springs 52 push the ratchet teeth 54 of the ratchet member 50 into engagement with the ratchet teeth 34 of the nut engaging ring 30. The rotation of the support member 36 therefore causes the rotation of the nut engaging ring 30, the internal surfaces 32 of which are engaged with the nut 12 which in turn rotates. All of these rotations are in rotational direction R1, which is anticlockwise as shown on the figures. When the full stroke of the hydraulic ram has been reached the hydraulic pressure is released and the flow reversed which causes the ram to retract pulling the support member 36 in the opposite direction to direction Dl. The ratchet teeth 34 and 54 are able to slide over each other and as a result the nut engaging ring 30 remain stationary whilst the support member 36 rotates in a clockwise direction. Once the hydraulic ram is fully retracted the extending stroke can be repeated until the required torque on the nut is reached which can be determined by the hydraulic pressure in the ram.

It will be appreciated by persons skilled in the art that above embodiments have been described by way of example only, and not in any limitative sense, and that various alterations and modifications are possible without departing from the scope of the invention as defined by the appended claims. For example, variations on the ratchet mechanism, which are used in other hydraulic torque wrenches and are familiar to person skilled in the art can equally be used in the device of the present invention.

The invention claimed is:

1. A hydraulic torque wrench for applying a rotational force to an object, the torque wrench comprising:

a body;

an object engaging portion for engaging the object to which rotational force is to be applied, the engaging portion having an engaging aperture having internal surfaces arranged to engage the object and a plurality of first ratchet teeth on an external surface thereof;

a support member for retaining the object engaging portion, the support member movable relative to said body and said object engaging portion;

at least one ratchet mechanism cooperating with said first ratchet teeth to facilitate the application of the rotational force to said object engaging portion in a first rotational direction in response to a force being applied to said support member in a first substantially linear direction and said ratchet mechanism preventing the application of a rotational force in a second rotational direction, opposite to said first rotational direction; and side plates extending from said body at least partially covering a junction between said object engaging portion and said support member, said side plates comprising an aperture through which said object can extend when the wrench is in use, wherein said aperture has a shape formed by two non-concentric overlapping circles comprising a first circle having a first centerpoint and a second circle having a second centerpoint, the centerpoint of the first circle located closer to the centerpoint of the second circle than to a periphery of the second circle.

2. The hydraulic torque wrench according to claim 1, wherein said first and second circles have different diameters.

3. The hydraulic torque wrench according to claim 1, wherein said first circle is concentric with an axis of rotation of said object engaging portion.

4. The hydraulic torque wrench according to claim 1, wherein said ratchet mechanism comprises a ratchet member having at least one second ratchet tooth for engaging said first ratchet teeth.

5. The hydraulic torque wrench according to claim 1, wherein said engaging aperture is substantially hexagonal.

6. The hydraulic torque wrench according to claim 1, further comprising at least one hydraulic ram for applying said force in said first substantially linear direction to said support member.

7. The hydraulic torque wrench according to claim 6, further comprising at least one connector portion for connecting said hydraulic ram to a supply of hydraulic fluid.

8. The hydraulic torque wrench according to claim 7, further comprising at least one hydraulic pump unit for supplying said hydraulic fluid under pressure to said hydraulic ram via said connector portion.

9. A hydraulic torque wrench for applying a rotational force to an object, the torque wrench comprising:

a body;

an object engaging portion for engaging the object to which rotational force is to be applied, the engaging portion having an engaging aperture having internal surfaces arranged to engage the object and a plurality of first ratchet teeth on an external surface thereof;

a support member for retaining the object engaging portion, the support member movable relative to said body and said object engaging portion;

at least one ratchet mechanism cooperating with said first ratchet teeth to facilitate the application of the rotational force to said object engaging portion in a first rotational direction in response to a force being applied to said support member in a first substantially linear direction and said ratchet mechanism preventing the application of a rotational force in a second rotational direction, opposite to said first rotational direction; and side plates extending from said body at least partially covering a junction between said object engaging portion and said support member, said side plates comprising an aperture through which said object can extend when the wrench is in use, wherein said aperture has a shape formed by two non-concentric overlapping circles comprising a first circle having a first centerpoint and a second circle having a second centerpoint, and wherein the first centerpoint of the first circle is located within the second circle and the second centerpoint of the second circle is located within the first circle.

10. A hydraulic torque wrench for applying a rotational force to an object, the torque wrench comprising:

a body;

an object engaging portion for engaging the object to which rotational force is to be applied, the engaging portion having an engaging aperture having internal surfaces arranged to engage the object and a plurality of first ratchet teeth on an external surface thereof;

a support member for retaining the object engaging portion, the support member movable relative to said body and said object engaging portion;

at least one ratchet mechanism cooperating with said first ratchet teeth to facilitate the application of the rotational force to said object engaging portion in a first rotational direction in response to a force being applied to said support member in a first substantially linear direction and said ratchet mechanism preventing the application of a rotational force in a second rotational direction, opposite to said first rotational direction; and side plates extending from said body at least partially covering a junction between said object engaging portion and said support member, said side plates comprising an aperture through which said object can extend when the wrench is in use, wherein said aperture has a shape formed by two non-concentric overlapping circles comprising a first circle having a first centerpoint and a second circle having a second centerpoint, wherein a reference line connects the first centerpoint of the first circle to the second centerpoint of the second circle without intersecting a periphery of either of the first and second circles.

* * * * *